US010332670B2

(12) United States Patent
Choi et al.

(10) Patent No.: US 10,332,670 B2
(45) Date of Patent: Jun. 25, 2019

(54) INDUCTOR AND MANUFACTURING METHOD THEREOF

(71) Applicant: SAMSUNG ELECTRO-MECHANICS CO., LTD., Suwon-si, Gyeonggi-do (KR)

(72) Inventors: Woon Chul Choi, Suwon-si (KR); Sung Hyun Kim, Suwon-si (KR); Hye Yeon Cha, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/728,161

(22) Filed: Oct. 9, 2017

(65) Prior Publication Data

US 2018/0033542 A1 Feb. 1, 2018

Related U.S. Application Data

(63) Continuation of application No. 15/221,968, filed on Jul. 28, 2016, now Pat. No. 10,014,102, which is a (Continued)

(30) Foreign Application Priority Data

Oct. 11, 2013 (KR) ..... 10-2013-0121228

(51) Int. Cl.
*H01F 27/28* (2006.01)
*H01F 17/00* (2006.01)
(Continued)

(52) U.S. Cl.
CPC ..... *H01F 27/2804* (2013.01); *H01F 17/0013* (2013.01); *H01F 27/292* (2013.01); *H01F 41/042* (2013.01)

(58) Field of Classification Search
CPC .... H01F 5/003; H01F 27/2804; H01F 27/292; H01F 27/29; H01F 27/32; H01F 27/323;
(Continued)

(56) References Cited

U.S. PATENT DOCUMENTS 4,457,792 A * 7/1984 Chitose ..... H01F 27/32 156/188
4,489,298 A * 12/1984 Hall ..... H01F 27/323 336/206
(Continued)

FOREIGN PATENT DOCUMENTS

CN 1292443 C 12/2006
CN 103180919 A 6/2013
(Continued)

OTHER PUBLICATIONS

Japanese Office Action issued in Japanese Application No. 2014-116524 dated Sep. 15, 2015, with English translation.
(Continued)

*Primary Examiner* — Mang Tin Bik Lian
(74) *Attorney, Agent, or Firm* — Morgan Lewis & Bockius LLP

(57) ABSTRACT

An inductor may include: a body, and a first and a second external electrode formed on end surfaces of the body. The body may include a coil support layer, a conductive coil formed on at least one surface of the coil support layer, a lamination part formed in a gap of the conductive coil and on an upper surface thereof, an insulating coating part formed to enclose an overall surface of the conductive coil on which the lamination part is formed, and upper and lower cover layers covering the overall surface of the conductive coil on which the insulating coating part is formed.

14 Claims, 4 Drawing Sheets

Related U.S. Application Data continuation of application No. 14/321,059, filed on Jul. 1, 2014, now Pat. No. 9,437,363.

(51) Int. Cl.
*H01F 41/04* (2006.01)
*H01F 27/29* (2006.01)

(58) Field of Classification Search
CPC .... H01F 27/324; H01F 17/0013; H01F 17/00; H01F 17/0006; H01F 3/08; H01F 41/042; H01F 41/04; H01F 2017/0073
USPC ..... 336/200, 223, 192, 233
See application file for complete search history.

(56) References Cited

U.S. PATENT DOCUMENTS

| | | | | |
|---|---|---|---|---|
| 6,977,796 | B2 | 12/2005 | Sasaki et al. | |
| 2001/0017420 | A1 | 8/2001 | Iwao et al. | |
| 2003/0151849 | A1* | 8/2003 | Sasaki | G11B 5/17 360/123.28 |
| 2010/0259353 | A1 | 10/2010 | Saito et al. | |
| 2012/0126926 | A1 | 5/2012 | Kroener et al. | |
| 2013/0147592 | A1 | 6/2013 | Yoo et al. | |
| 2013/0222101 | A1 | 8/2013 | Ito et al. | |
| 2013/0249664 | A1 | 9/2013 | Tonoyama et al. | |
| 2015/0035634 | A1* | 2/2015 | Nakamura | H01F 17/0013 336/170 |

FOREIGN PATENT DOCUMENTS

| | | | |
|---|---|---|---|
| JP | 02-094013 | A | 4/1990 |
| JP | 09-270323 | A | 10/1997 |
| JP | 2005-109097 | A | 4/2005 |
| JP | 2005-210010 | A | 8/2005 |
| JP | 2006-156855 | A | 6/2006 |
| JP | 2007-067214 | A | 3/2007 |
| JP | 2013-120938 | A | 6/2013 |
| KR | 10-2006-0061709 | A | 6/2006 |
| KR | 2010-0113029 | A | 10/2010 |

OTHER PUBLICATIONS

Chinese Office Action issued in Application No. 201410283853.0 dated Jun. 22, 2016 with English translation.
Japanese Office Action issued in Application No. 2014-116524 dated Aug. 2, 2016.
U.S. Final Office Action dated Jul. 7, 2017 issued in U.S. Appl. No. 15/221,968.
U.S. Final Office Action dated Jan. 30, 2017 issued in U.S. Appl. No. 15/221,968.
U.S. Non-final Office Action dated Oct. 19, 2017 issued in U.S. Appl. No. 15/221,968.

* cited by examiner

INDUCTOR AND MANUFACTURING METHOD THEREOF

CROSS-REFERENCE TO RELATED APPLICATIONS

This application is a Continuation of U.S. patent application Ser. No. 15/221,968, filed on Jul. 28, 2016, which is a Continuation of U.S. patent application Ser. No. 14/321,059, filed on Jul. 1, 2014, now issued as U.S. Pat. No. 9,437,363, issued on Sep. 6, 2016, which claims the benefit of Korean Patent Application No. 10-2013-0121228, filed on Oct. 11, 2013, the disclosures of which are incorporated herein by reference.

BACKGROUND

The present disclosure relates to an inductor and a manufacturing method thereof.

An inductor, an important passive element configuring an electronic circuit together with a resistor and a capacitor, is used in various systems and components such as a low noise amplifier, a mixer, a voltage controlled oscillator, a matching coil, and the like.

Such an inductor may be classified as, for example, a wire wound inductor, a multilayer inductor, a thin film inductor, or further type of inductor, according to the structure thereof.

Among these types of inductor, wire wound inductors are commonly formed by winding a coil around a ferrite core, or the like.

In such a wire wound inductor, since stray capacitance may be generated between coil portions, in order to obtain a high degree of inductance, an amount of coil turns need to be increased, but in a case in which the turns of the coil are increased, high frequency characteristics may be deteriorated.

A multilayer inductor may be formed by stacking a plurality of ceramic sheets.

Such a multilayer inductor may have a structure in which a coil shaped metal pattern is formed on each of the ceramic sheets included therein, and the metal patterns may have a single electrical connection while being sequentially connected to each other by a plurality of conductive vias provided in each of the ceramic sheets.

The multilayer inductor is suitable for mass production due to having such a structure, and when being compared with wire wound inductors, multilayer inductors may have excellent high frequency characteristics.

However, in multilayer inductors, since a saturation magnetization value of materials configuring the metal pattern is low, and in the case of manufacturing compact multilayer inductors, the amount of stacked metal patterns may be limited, while direct current (DC) bias characteristics may be decreased, such that a sufficient amount of current may not be obtained.

A thin film inductor may be manufactured by forming a thin film shaped conductive coil on a coil support layer.

Such a thin film inductor may use a material having a saturation magnetization value higher than that of the multilayer inductor, and in the case of manufacturing compact thin film inductors, there is no limitation on a height thereof, and it may be easy to form an internal circuit pattern. Therefore, recently, research into thin film inductors has been actively conducted.

Particularly, as display device screens are increased in size in accordance with the implementation of high degrees of performance in portable devices such as smartphones, tablet personal computers (PCs), and the like, the speed of an accelerated processing unit (APU) may be increased, while power consumption may be increased due to the use of a multi-core processor, or the like. Therefore, in the case of a thin film inductor mainly used in a DC-DC converter, a noise filer, or the like, a thin film inductor capable of implementing high inductance and low DC resistance has also been demanded.

In addition, since the miniaturization and thinning of various electronic devices have progressed in accordance with the development of information technology (IT), thin film inductors used in such electronic devices are also required to be miniaturized and thinned.

Meanwhile, recently, in order to improve performance of thin film inductors, technology in which a magnetic body is formed on a coil support layer together with a thin film conductive coil has been developed.

Performance of such thin film inductors is significantly dependent on magnetic properties of soft ferrite, or the like, used to configure bodies thereof.

A magnetic body used in a thin film inductor needs to have a sufficient degree of permittivity in a high frequency region at the time of the application thereof at a high frequency, needs not to be thermally and mechanically degraded during a manufacturing process of the inductor, and needs to be insulated from the conductive coil. Therefore, an insulation layer is formed between the magnetic body and the conductive coil.

In a thin film inductor according to the related art, an insulation layer was formed between the magnetic body and the conductive coil using a vacuum impregnation method, or the like.

However, such a method of forming the insulation layer may cause a defect such as a phenomenon in which the insulating layer may do not completely fill gaps in a conductive coil and thus, portions of the gaps may remain empty in the case of a small product, that is, a defect in which voids are generated in the gaps of the conductive coil.

That is, in the case of performing photocuring using a dry film in a thin film inductor according to the related art, an amount of an insulating margin portion, sufficient to cause photocuring up to a lower portion of the conductive coil having a thickness of 100 μm or more may be required. However, inductance of the inductor may be reduced in accordance with an increase in the insulating margin portion. Thus, in the case of forming an insulating layer through coating a surface of the conductive coil, since voids are generated in the gaps of the conductive coil, reliability may be significantly deteriorated under high temperature and high moisture conditions.

SUMMARY

Additional aspects and/or advantages will be set forth in part in the description which follows and, in part, will be apparent from the description, or may be learned by practice of the invention.

An aspect may provide an inductor having improved reliability by preventing a phenomenon in which voids are generated in a portion of gaps in a conductive coil at the time of forming an insulating layer on a surface of the conductive coil according to the related art, and having relatively improved inductance by further securing an insulating margin portion required for performing a photocuring process while decreasing a total thickness of the insulating layer formed between a body and the conductive coil.

According to an aspect, an inductor may include: a body; and first and second external electrodes disposed on end surfaces of the body, wherein the body includes: a coil support layer; a conductive coil disposed on at least one surface of the coil support layer; a lamination part formed in a gap of the conductive coil and on an upper surface thereof; an insulating coating part formed to enclose an overall surface of the conductive coil on which the lamination part is formed; and upper and lower cover layers covering the overall surface of the conductive coil on which the insulating coating part is formed.

The conductive coil may be disposed to have a spiral shape.

The conductive coil may be provided in plural, and the plurality of coils may be disposed on both surfaces of the coil support layer to be vertically symmetrical to each other.

The insulating coating part may be formed of a material containing epoxy.

The insulating coating part may have an average thickness of about 0.5 μm to about 15 μm.

The coil support layer may be a substrate formed of an insulating material.

The conductive coil may have a thickness of about 100 μm or more.

A gap interval of the conductive coil may be about 8 μm to about 12 μm.

According to an aspect, a manufacturing method of an inductor may include: preparing a coil support layer; forming a conductive coil on at least one surface of the coil support layer; forming a lamination part in a gap of the conductive coil and on an upper surface thereof by performing a lamination process on one surface of the coil support layer; forming an insulating coating part to cover an overall surface of the conductive coil having the lamination part formed thereon by coating a circumference of the conductive coil having the lamination part formed thereon, with an insulating material; preparing a body including upper and lower cover layers formed thereon by covering the coil support layer on which the insulating coating part is formed in such a manner that both end surfaces of the coil support layer are exposed; and forming first and second external electrodes on both end surfaces of the body to be connected to the exposed surfaces of the coil support layer, respectively.

BRIEF DESCRIPTION OF THE DRAWINGS

The above and other aspects, features and other advantages will be more clearly understood from the following detailed description taken in conjunction with the accompanying drawings, in which.

DETAILED DESCRIPTION

Figure 1:
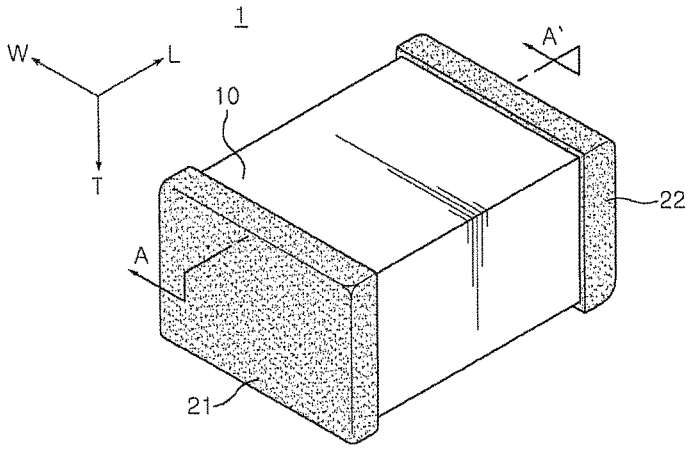
FIG. 1 is a perspective view showing an inductor according to an embodiment.

Embodiments will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

FIG. 1 is a perspective view showing an inductor according to an embodiment.

Referring to FIG. 1, an inductor 1 according to the embodiment may include a body 10 and first and second external electrodes 21 and 22 formed on both end surfaces of the body 10.

Directions of the body 10 will be defined in order to clearly describe the embodiment. L, W and T shown in FIG. 1 refer to a length direction, a width direction, and a thickness direction of the body 10, respectively. Here, the thickness direction may be used to have the same concept as a vertical direction.

The first and second external electrodes 21 and 22 may contain at least one metal capable of providing electrical conductivity, for example, at least one metal selected from a group consisting of gold, silver, platinum, copper, nickel, palladium, and an alloy thereof.

In this case, if necessary, a nickel plating layer (not shown) or a tin plating layer (not shown) may be further formed on surfaces of the first and second external electrodes 21 and 22.

Figure 2:
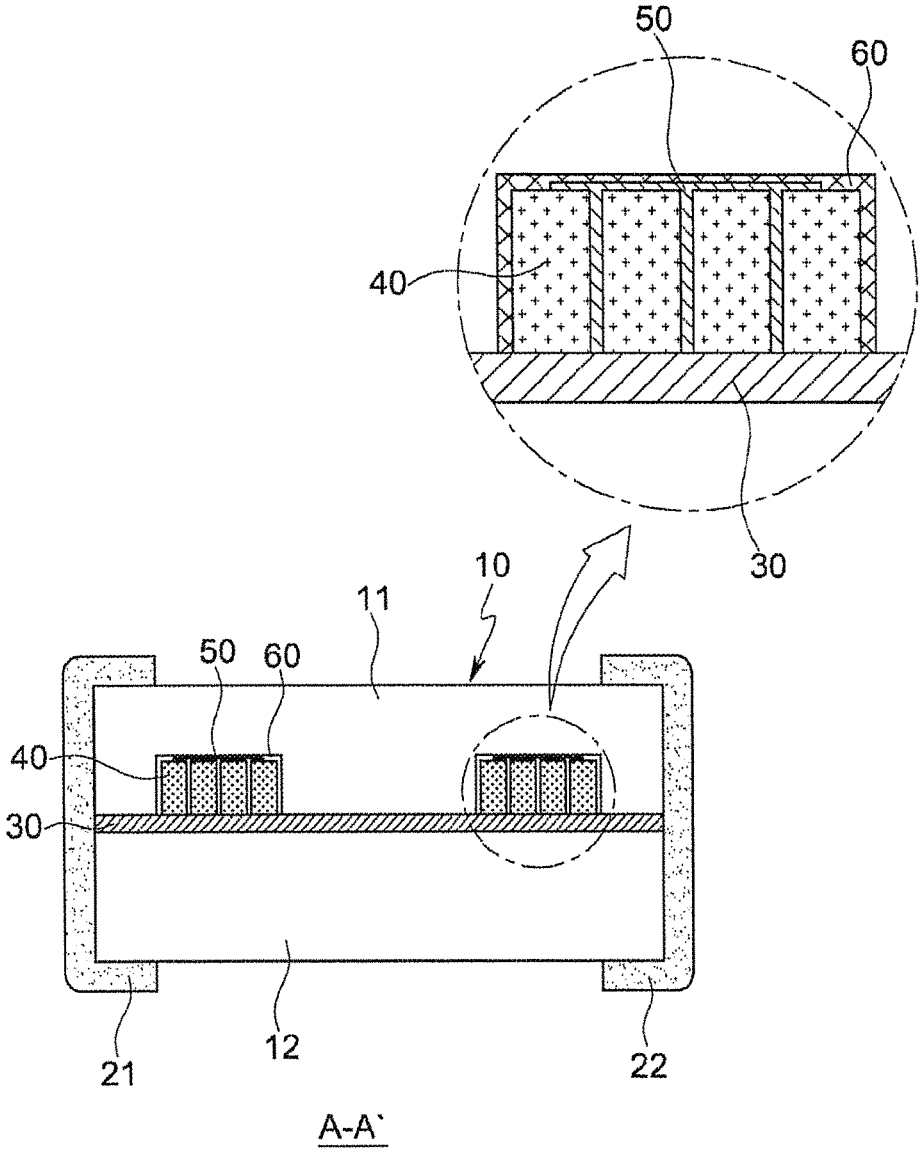
FIG. 2 is a cross-sectional view taken along line A-A' of FIG. 1.

FIG. 2 is a schematic cross-sectional view taken along line A-A' of FIG. 1.

Referring to FIG. 2, the body 10 may have a substantially rectangular parallelepiped shape and include a coil support layer 30, a conductive coil 40, a lamination part 50, an insulating coating part 60, and upper and lower cover layers 11 and 12.

The coil support layer 30 may be configured as a substrate formed of an insulating material, for example, a bismaleimide-triazine (BT) resin or a photosensitive polymer, but is not limited thereto.

In this case, the substrate may be, for example, a glass substrate, a ceramic substrate, a semiconductor substrate, a resin substrate such as FR4 substrate, a polyimide substrate, or the like, may be used, but is not limited thereto.

The conductive coil 40 may be formed on an upper surface of the coil support layer 30 by various methods such as an electroplating method, a screen printing method, and the like.

Preferably, the conductive coil 40 may, for example, have a spiral shape, but is not limited thereto. For example, the conductive coil 40 may have a polygonal shape such as a tetragonal shape, a pentagonal shape, a hexagonal shape, or the like, a circular shape, an oval shape, or the like, and if necessary, the conductive coil 40 may be irregularly formed.

However, when the body 10 has a rectangular parallelepiped shape as in the exemplary embodiment, the conductive coil 40 may need to have a tetragonal shape. Only in a case in which the conductive coil 40 has a tetragonal shape, an area of the conductive coil 40 may be significantly increased, such that intensity of a magnetic field induced to the conductive coil 40 may be significantly increased.

Both ends of the conductive coil 40 may be exposed to both end surfaces of the body 10 through both end surface of the coil support layer 30 to thereby be electrically connected to the first and second external electrodes 21 and 22, respectively.

Further, the conductive coil 40 may contain at least one metal selected from a group consisting of gold, silver, platinum, copper, nickel, palladium, and an alloy thereof, but the present disclosure is no limited thereto. The conductive coil 40 according to the embodiment may be formed of any material as long as the material may provide electrical conductivity.

The lamination part 50 serving as a primary insulating layer for insulation between the conductive coil 40 and the body 10, may be closely adhered to a portion of an upper surface of the conductive coil 40, a central portion thereof in FIGS. 1 and 2, while filling gaps in the conductive coil 40 having a spiral shape.

The insulating coating part 60 serving as a secondary insulating layer for insulation between the conductive coil 40 and the body 10, may be formed to enclose an overall surface of the conductive coil 40 including the upper surface of the conductive coil 40 on which the lamination part 50 is formed.

The insulating coating part 60 may be formed of a material having insulating properties. For example, filler may be used and further, a polymer, photocurable acrylate, thermosetting epoxy, or the like, may be used, but is not limited thereto.

Therefore, due to the insulating coating part 60, a thickness of the insulating layer may be decreased and a relatively inexpensive material is used to thereby lead to a decrease in a manufacturing cost, as compared to the case of using a dry film solder resist (DFSR) as an insulating layer according to the related art.

For example, a thickness of the insulating coating part 60 may be about 0.5 μm to about 15 μm, but is not limited thereto.

Further, in the case of adjusting an amount of the insulating material coated as described above, the insulating coating part may have properties corresponding to characteristics of a product.

In a thin film inductor, an insulating layer may be formed between a magnetic body and a conductive coil by a vacuum impregnation method, or the like.

The formation method of an insulating layer as described above may cause a defect such as a phenomenon in which the insulating layer may do not completely fill gaps in a conductive coil and thus, portions of the gaps may remain empty in the case of a small product having a conductive coil thickness of about 100 μm or more and a gap interval of about 10 μm for example, that is, a defect in which voids are generated in the gaps of the conductive coil.

That is, in the case of performing photocuring using a dry film in a thin film inductor, an amount of an insulating margin portion, sufficient to cause photocuring up to a lower portion of the conductive coil having a thickness of about 100 μm or more may be required. However, inductance of the inductor may be reduced in accordance with an increase in the insulating margin portion. Thus, in the case of forming an insulating layer through coating a surface of the conductive coil, since voids are generated in the gaps of the conductive coil, short circuits may occur under high temperature and high moisture conditions, such that reliability may be significantly deteriorated.

However, according to the embodiment, in the case of a small product in which the conductive coil 40 has a thickness of about 100 μm or more and a gap interval is about 8 μm to about 12 μm, a double insulating layer structure may be configured to have the lamination part 50 formed in the gaps of the conductive coil 40 and on the upper surface thereof in which reliability is low, and the insulating coating part 60 formed to enclose the overall surface of the conductive coil 40 including the upper surface of the conductive coil 40 on which the lamination part 50 is formed.

Therefore, a photocurable region in the conductive coil may be reduced in order to decrease an existing insulating margin portion, due to the presence of the lamination part 50 formed by a primary lamination process. Further, since the voids generated in the gaps of the conductive coil 40, or the like, may be easily removed by vacuum and pressing operations after the primary lamination process, the deterioration in reliability due to the voids may be effectively prevented.

In addition, after the removal process of the voids, a process of coating a secondary insulating material on the surface of the conductive coil 40 may be performed to enclose the overall surface of the conductive coil 40. Through the processes, an insulating margin portion may be decreased to lead to a decrease in the volume of an insulating layer, thereby allowing for an increase in inductance of the inductor 1, as compared to a thin film inductor according to the related art.

A high temperature load test was performed on thin film inductors having a single insulating layer structure according to the related art as Comparative Examples and a thin film inductor having a double insulating layer structure as an Inventive Example according to an embodiment. Ls values of the respective inductors and whether or not reliability of the respective inductors was satisfied are provided in the following Table 1. Here, a product having a large number of voids generated at the time of manufacturing thereof was used in Comparative Example 1, and a product having relatively few voids generated at the time of manufacturing thereof was used in Comparative Example 2.

Test result values of the respective samples were measured by applying a current of 2.3 A at 85° C. and 85% RH for 500 hours.

TABLE 1

| | Comparative Example 1 L (μH) | Comparative Example 2 L (μH) | Inventive Example L (μH) |
|---|---|---|---|
| 1 | 0.8516 | 0.8378 | 0.9402 |
| 2 | 0.8594 | 0.8449 | 0.8797 |
| 3 | 0.8406 | 0.8394 | 0.9359 |
| 4 | 0.8466 | 0.8175 | 0.8895 |
| 5 | 0.8129 | 0.82 | 0.9324 |
| 6 | 0.827 | 0.8327 | 0.9404 |
| 7 | 0.8413 | 0.8412 | 0.9557 |
| 8 | 0.8452 | 0.8496 | 0.9163 |
| 9 | 0.8444 | 0.844 | 0.9491 |
| 10 | 0.8383 | 0.8379 | 0.9262 |
| 11 | 0.8204 | 0.83 | 0.9222 |
| 12 | 0.8619 | 0.8356 | 0.9186 |
| 13 | 0.8343 | 0.8413 | 0.9255 |
| 14 | 0.8156 | 0.8352 | 0.8967 |
| 15 | 0.8666 | 0.8326 | 0.9287 |
| 16 | 0.8339 | 0.8462 | 0.9426 |
| 17 | 0.8465 | 0.8318 | 0.9338 |
| 18 | 0.838 | 0.85 | 0.9251 |
| 19 | 0.8424 | 0.8551 | 0.9249 |
| 20 | 0.8523 | 0.8492 | 0.9134 |
| Maximum | 0.870 | 0.855 | 0.972 |
| Minimum | 0.817 | 0.817 | 0.839 |
| Average | 0.844 | 0.837 | 0.927 |

Referring to Table 1, a thickness of the upper and lower cover layers 11 and 12 formed of a magnetic body may be increased by an amount equal to a decrease in the volume of the insulating layer, such that the Ls value may be increased by about 1% to about 20%, as compared to the thin film inductors formed of the single insulating layer according to the related art.

For example, in the thin film inductors formed of the single insulating layer according to the related art, a Ls value was 1.0±0.2 uH, while in the thin film inductor according to the exemplary embodiment, an Ls average value was about 0.927 uH.

Meanwhile, in Comparative Example 2, reliability thereof was defective in some cases thereof.

The upper and lower cover layers 11 and 12 may be formed using a paste formed of a magnetic ferrite material or a complex of a metal magnetic powder and a polymer, or may be formed of a material containing a magnetic substance such as nickel-zinc-copper ferrite.

The upper and lower cover layers 11 and 12 as described above may cover the overall surface of the conductive coil 40 on which the insulating coating part 60 is formed, to thereby prevent basic electric properties of the conductive coil 40 from being deteriorated by external impacts or foreign materials.

Figure 3:
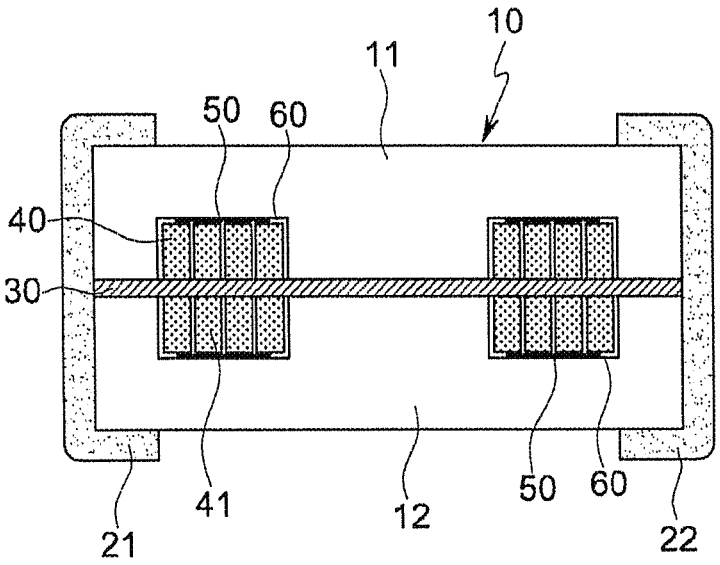
FIG. 3 is a cross-sectional view showing an inductor according to an embodiment.

FIG. 3 is a cross-sectional view showing an inductor according to an embodiment.

Referring to FIG. 3, conductive coils 40 and 41 may be formed on upper and lower surfaces of the coil support layer 30 to be vertically symmetrical to each other based on the coil support layer 30.

In this case, the lamination part 50 and the insulating coating part 60 may be formed on the conductive coil 41 formed on the lower surface of the coil support layer 30 in the same manner as that of the conductive coil 40 formed on the upper surface thereof. Since the lamination part 50 and the insulating coating part 60 formed on the conductive coil 41 formed on the lower surface of the coil support layer 30 are similar to those formed on the conductive coil 40 formed on the upper surface of coil support layer 30 according to the foregoing exemplary embodiment, a detailed description thereof will be omitted in order to avoid an overlapped description.

In this case, a photosensitive insulating material may be interposed between the conductive coils 40 and 41 vertically adjacent to each other with the coil support layer 30 interposed therebetween, and the conductive coils 40 and 41 may be electrically connected to each other by a conductive via (not shown).

The conductive via may be formed by forming a through hole (not shown) penetrating through the coil support layer 30 in the thickness direction and then filling the through hole with a conductive paste or the like.

FIGS. 4A through 4E are cross-sectional views showing a manufacturing method of an inductor according to an embodiment.

Hereinafter, the manufacturing method of an inductor according to an embodiment will be described with reference to FIGS. 4A through 4E.

Referring to 4A, first, the coil support layer 30 may be prepared.

The coil support layer 30 may be fabricated as a substrate formed of an insulating or magnetic material.

Next, the conductive coil 40 may be formed on the upper surface of the coil support layer 30. In this case, the conductive coil 40 may be formed by plating the upper surface of the coil support layer 30 with a conductive paste.

In this case, if necessary, the conductive coils 40 and 41 may be formed on the upper and lower surfaces of the coil support layer 30, respectively, to be vertically symmetrical to each other.

In this case, after plating the upper surface of the coil support layer 30 with the conductive paste to form the first conductive coil 40, a conductive via penetrating through the coil support layer 30 may be formed and then, the second conductive coil 41 may be formed by plating the lower surface of the coil support layer 30, opposite to the surface on which the first conductive coil 40 is formed, with the conductive paste. Alternatively, the conductive coils 40 and 41 may be formed in reverse sequence.

Here, the first and second conductive coils 40 and 41 may be electrically connected to each other by the conductive via.

The conductive via may be formed by forming a through hole in the coil support layer 30 in the thickness direction using laser, a punching machine, or the like, and then filling the through hole with a conductive paste, or the like.

In this case, the conductive paste may contain a metal capable of providing electrical conductivity, for example, at least one selected from a group consisting of gold, silver, platinum, copper, nickel, palladium, and an alloy thereof.

Further, the first and second coil layers 40 and 41 and the conductive via may be formed of the same material for realizing more stable electric properties, but the present disclosure is not limited thereto.

Meanwhile, the conductive coil 40 may be formed by pressing and attaching a conductive metal thin film such as a copper thin film onto the coil support layer 30 and then selectively wet-etching the conductive metal thin film.

In this case, the selective etching may be performed by a photolithography process.

That is, the conductive coil 40 may be formed by forming a photoresist layer having a coil pattern in a spiral shape, or the like, on the conductive metal thin film adhered to the coil support layer 30 and then etching the conductive metal thin film with an etching solution using the photoresist layer as an etching mask.

In addition, as another method for forming the conductive coil 40, a screen printing method may be used.

In the screen printing method, the conductive coil 40 may be formed by forming a screen having a pattern opposite to the coil pattern on the coil support layer 30, printing a conductive paste using the screen as a printing mask, and drying the conductive paste.

Meanwhile, a plurality of coil support layers 30 may be stacked in the thickness direction of the body 10, and one ends of the conductive coils of the coil support layers 30 adjacent to each other in a stacking direction may be electrically connected to each other through a via conductor (not shown), respectively.

Referring to 4B, next, a lamination process may be performed on one surface of the conductive coil 40.

Therefore, the lamination part 50 may be thinly formed in the gaps and on the upper surface of the conductive coil 40 having a spiral shape as a primary insulating layer.

The lamination part 50 may serve as an insulating layer and serve to prevent the occurrence of voids in the gaps of the conductive coil 40.

Referring to FIG. 40, then, the insulating coating part 60 may be formed by coating a circumference of the conductive coil 40 on which the lamination part 50 is formed, with a material having insulating properties such as a polymer or epoxy, so as to enclose and cover the overall surface of the conductive coil 40.

In this case, the insulating coating part 60 may have an average thickness of about 0.5 μm to about 15 μm.

Therefore, the gap and upper surface of the conductive coil 40 in which reliability is low may have a double insulating structure due to the presence of lamination part 50 and the insulating coating part 60.

Figure 4A:
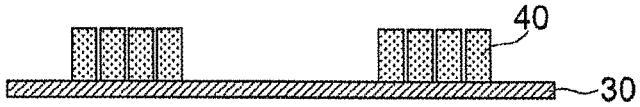
FIGS. 4A through 4E are cross-sectional views showing a manufacturing method of an inductor according to an embodiment.
Figure 4B:
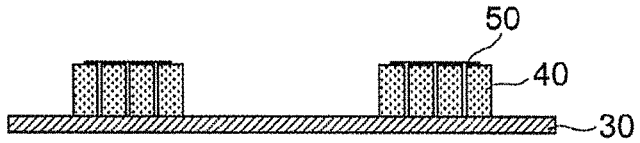
Figure 4C:
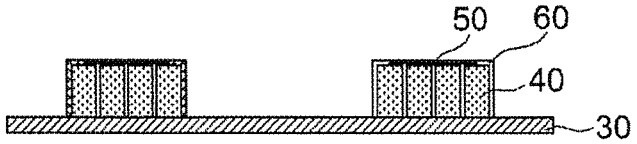
Figure 4D:
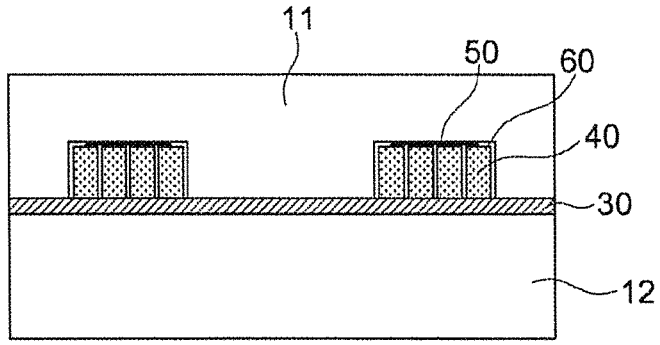

Referring to FIG. 4D, next, the body 10 having the upper and lower cover layers 11 and 12 may be prepared by covering the coil support layer 30 on which the insulating coating part 60 is formed with a material formed of ferrite, a complex of a metal magnetic powder and a polymer, or the like in such a manner that both end surfaces of the coil support layer 30 may be exposed.

In addition to the material described above, the upper and lower cover layers 11 and 12 may be formed of a composite material containing a polymer material, a ceramic material, glass, silicon, or at least two thereof, if necessary.

In this case, as another method, if necessary, the upper and lower cover layers 11 and 12 may be formed by stacking cover sheets containing a material formed of ferrite, a complex of a metal magnetic powder and a polymer, or the like, on the upper and lower surfaces of the coil support layer 30 and then pressing the stacked cover sheets, or may be formed by casting a paste formed of the same material as described above.

Figure 4E:
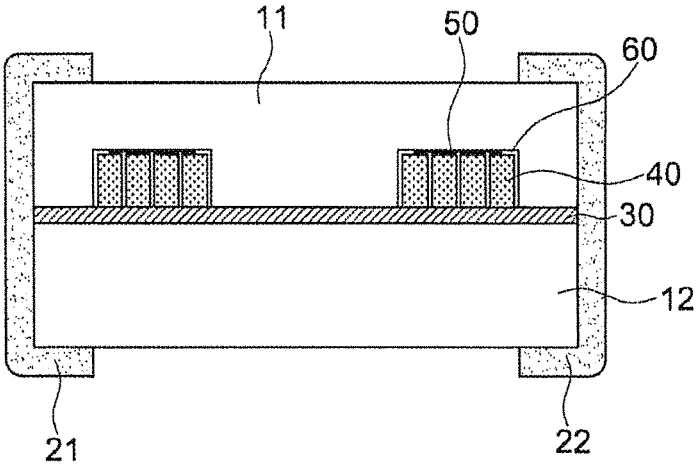

Referring to FIG. 4E, next, the first and second external electrodes 21 and 22 may be formed on the both end surfaces of the body 10 to be in contact with exposed portions of the coil support layer 30, thereby being electrically connected to the exposed portions, respectively.

In this case, the first and second external electrodes 21 and 22 may be formed by dipping the body 10 in a conductive paste, printing a conductive paste on the both end surfaces of the body 10, or using a deposition or sputtering method, or the like.

In addition, the conductive paste may contain a metal capable of providing electrical conductivity to the first and second external electrodes 21 and 22, for example, at least one selected from a group consisting of gold, silver, platinum, copper, nickel, palladium, and an alloy thereof.

Meanwhile, if necessary, a nickel plating layer and a tin plating layer may be further formed on surfaces of the first and second external electrodes 21 and 22.

As set forth above, according to an embodiment, a phenomenon in which voids are generated in a portion of gaps in a conductive coil at the time of forming an insulating layer on a surface of the conductive coil according to the related art may be prevented due to the presence of a thin lamination part primarily formed in the gaps and on the upper surface of the conductive coil, such that product reliability may be improved. In addition, inductance of a thin film inductor may be relatively improved by decreasing the total thickness of the insulating layer while further securing an insulating margin portion required for performing a photocuring process due to the presence of an insulating coating part formed to enclose the overall surface of the conductive coil on which the lamination part is formed.

Further, manufacturing costs may be decreased through using an inexpensive insulating material, instead of a relatively expensive DFSR used at the time of forming an insulating layer in the related art.

While exemplary embodiments have been shown and described above, it will be apparent to those skilled in the art that modifications and variations could be made without departing from the spirit and scope of the present disclosure as defined by the appended claims.

Although a few embodiments have been shown and described, it would be appreciated by those skilled in the art that changes may be made in these embodiments without departing from the principles and spirit of the present disclosure, the scope of which is defined in the claims and their equivalents.

The invention claimed is:

1. An inductor comprising:

a body, including:

a coil support layer, a conductive coil on a surface, of the coil support layer, a first insulating layer between adjacent turns of the conductive coil and extending higher than an upper surface of the conductive coil in a stacking direction, a second insulating layer enclosing the first insulating layer and the conductive coil, and a cover layer comprising magnetic material and covering the second insulating layer; and external electrodes on respective end surfaces of the body, wherein the second insulating layer is not disposed at a lower position than a bottom surface of the conductive coil, wherein an inner side surface of the innermost coil pattern of the conductive coil is directly covered with the second insulating layer, and wherein an upper surface of the innermost coil pattern in the stacking direction is covered by the first insulating layer and the second insulating layer, and a portion of the innermost coil pattern not covered by the first insulating layer is covered by the second insulating layer.

2. The inductor of claim 1, wherein the width of the first insulating layer disposed between adjacent turns is smaller than that of the turns of the conductive coil.

3. The inductor of claim 1, wherein a gap interval between adjacent turns of the conductive coil in the conductive coil is substantially filled with the first insulating layer.

4. The inductor of claim 1, wherein the first insulating layer is formed of a material different from that of the second insulating layer.

5. The inductor of claim 1, wherein the first insulating layer encloses one or more turns of the conductive coil.

6. The inductor of claim 5, wherein the first insulating layer covers a portion of an upper surface at least one of an inner coil or outer coil of the conductive coil.

7. The inductor of claim 1, wherein the conductive coil has a spiral shape.

8. The inductor of claim 1, wherein the first insulating layer has an average thickness of about 0.5 μm to about 15 μm.

9. The inductor of claim 1, wherein the second insulating layer has an average thickness of about 0.5 μm to about 15 μm.

10. The inductor of claim 1, wherein a gap between adjacent turns of the conductive coil is about 8 μm to about 12 μm.

11. The inductor of claim 1, wherein the second insulating layer is formed of a material containing epoxy.

12. The inductor of claim 1, wherein the coil support layer is a substrate formed of an insulating material.

13. The inductor of claim 1, wherein the conductive coil has a thickness of about 100 μm or more.

14. An inductor comprising:

a body, including:

a coil support layer, an upper conductive coil on a surface of the coil support layer, a lower conductive coil on an opposite surface of the coil support layer and connected to the upper conductive coil, a first upper insulating layer between adjacent turns of the upper conductive coil and extending higher than an upper surface of the upper conductive coil in a stacking direction, a first lower insulating layer between adjacent turns of the lower conductive coil and extending lower than a lower surface of the lower conductive coil in the stacking direction, a second upper insulating layer enclosing the first upper insulating layer and the upper conductive coil, a second lower insulating layer enclosing the first lower insulating layer and the lower conductive coil, an upper cover layer comprising magnetic material and covering the second upper insulating layer, and a lower cover layer comprising magnetic material and covering the second lower insulating layer;

a first external electrode on an end surface of the body and connected to the upper conductive coil; and a second external electrode on an opposite surface of the body and connected to the lower conductive coil, wherein the second upper insulating layer is not disposed at a lower position than a bottom surface of the upper conductive coil, wherein the second lower insulating layer is not disposed at a higher position than an upper surface of the lower conductive coil, wherein an inner side surface of an innermost coil pattern of the upper conductive coil is directly covered with the second upper insulating layer, and wherein an inner side surface of an innermost coil pattern of the lower conductive coil is directly covered with the second lower insulating layer, and wherein an upper surface of the innermost coil pattern of the upper conductive coil in the stacking direction is covered by the first upper insulating layer and the second upper insulating layer, and a portion of the innermost coil pattern of the upper conductive coil not covered by the first upper insulating layer is covered by the second upper insulating layer, and wherein a lower surface of the innermost coil pattern of the lower conductive coil in the stacking direction is covered by the first lower insulating layer and the second lower insulating layer, and a portion of the innermost coil pattern of the lower conductive coil not covered by the first lower insulating layer is covered by the second lower insulating layer.

* * * * *